US009423175B2

(12) United States Patent
Mak

(10) Patent No.: US 9,423,175 B2
(45) Date of Patent: Aug. 23, 2016

(54) FLEXIBLE NGL RECOVERY METHODS AND CONFIGURATIONS

(71) Applicant: FLUOR TECHNOLOGIES CORPORATION, Aliso Viejo, CA (US)

(72) Inventor: John Mak, Santa Ana, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 159 days.

(21) Appl. No.: 14/210,061

(22) Filed: Mar. 13, 2014

(65) Prior Publication Data

US 2014/0260420 A1 Sep. 18, 2014

Related U.S. Application Data

(60) Provisional application No. 61/785,329, filed on Mar. 14, 2013.

(51) Int. Cl.
*F25J 3/00* (2006.01)
*F25J 3/02* (2006.01)

(52) U.S. Cl.
CPC ..... *F25J 3/0209* (2013.01); *F25J 3/0233* (2013.01); *F25J 3/0238* (2013.01); *F25J 3/0242* (2013.01); *F25J 2200/02* (2013.01); *F25J 2200/04* (2013.01); *F25J 2200/70* (2013.01); *F25J 2200/72* (2013.01); *F25J 2200/74* (2013.01); *F25J 2200/76* (2013.01); *F25J 2200/94* (2013.01); *F25J 2205/04* (2013.01); *F25J 2215/02* (2013.01); *F25J 2215/60* (2013.01); *F25J 2215/62* (2013.01); *F25J 2230/60* (2013.01); *F25J 2240/02* (2013.01); *F25J 2245/02* (2013.01); *F25J 2270/90* (2013.01);

(Continued)

(58) Field of Classification Search
CPC ..... F25J 3/0209; F25J 3/0233; F25J 3/0238; F25J 3/0242; F25J 2200/70; F25J 2200/74; F25J 2200/76; F25J 2215/60; F25J 2215/62; F25J 2240/02; F25J 2240/40; F25J 2280/02
See application file for complete search history.

(56) References Cited

U.S. PATENT DOCUMENTS

| | | | | |
|---|---|---|---|---|
| 5,881,569 | A | 3/1999 | Campbell | |
| 6,116,050 | A | 9/2000 | Yao | |
| 6,244,070 | B1 * | 6/2001 | Lee | F25J 3/0209 62/620 |

(Continued)

FOREIGN PATENT DOCUMENTS

| | | | |
|---|---|---|---|
| WO | 2004017002 | A1 | 2/2004 |
| WO | 2004065868 | A2 | 8/2004 |

(Continued)

*Primary Examiner* — Keith Raymond
(74) *Attorney, Agent, or Firm* — Conley Rose, P.C.; Kristin Jordan Harkins

(57) ABSTRACT

A natural gas liquids plant uses a demethanizer and a deethanizer in a two-column or single column configuration that can be used for ethane recovery and ethane rejection. During ethane recovery, 95% ethane recovery and 99% propane recovery are achieved, while during ethane rejection the sales gas Wobbe Index requirement is maintained while maintaining 95% propane recovery. A residue gas recycle exchanger is most preferably configured to use the demethanizer overhead product to either cool a portion of the residue gas and a portion of the feed gas during ethane recovery, or to cool a portion of the feed gas using two distinct heat transfer areas to produce a feed gas reflux at significantly lower temperature.

14 Claims, 3 Drawing Sheets

(52) U.S. Cl.
CPC ..... *F25J 2280/02* (2013.01); *F25J 2290/40* (2013.01)

(56) References Cited

U.S. PATENT DOCUMENTS

| | | | | |
|---|---|---|---|---|
| 6,401,486 | B1 * | 6/2002 | Lee | F25J 1/0022 62/623 |
| 6,453,698 | B2 | 9/2002 | Jain | |
| 8,209,996 | B2 | 7/2012 | Mak | |
| 2007/0240450 | A1 * | 10/2007 | Mak | F25J 3/0209 62/626 |
| 2008/0016909 | A1 | 1/2008 | Lu | |
| 2010/0011809 | A1 * | 1/2010 | Mak | F25J 3/0209 62/620 |
| 2010/0043488 | A1 | 2/2010 | Mak | |
| 2010/0126187 | A1 * | 5/2010 | Mak | F17C 7/04 62/50.2 |
| 2010/0206003 | A1 * | 8/2010 | Mak | F25J 3/0209 62/630 |
| 2013/0014390 | A1 | 1/2013 | Mak | |
| 2014/0007616 | A1 | 1/2014 | Mak | |

FOREIGN PATENT DOCUMENTS

| | | | |
|---|---|---|---|
| WO | 2004076946 | A2 | 9/2004 |
| WO | 2005045338 | A1 | 5/2005 |
| WO | 2007014069 | A2 | 2/2007 |
| WO | 2008002592 | A2 | 1/2008 |
| WO | 2012087740 | A1 | 6/2012 |
| WO | 2012177749 | A2 | 12/2012 |

* cited by examiner

FLEXIBLE NGL RECOVERY METHODS AND CONFIGURATIONS

This application claims priority to U.S. provisional application with the Ser. No. 61/785,329, which was filed Mar. 14, 2013.

FIELD OF INVENTION

The field of invention is processing of natural gas, especially as it relates to methods and configurations for a natural gas liquid (NGL) plant for high ethane recovery and variable ethane rejection, while maintaining high propane recovery.

BACKGROUND OF THE INVENTION

Most natural gas plants are designed to condition a feed gas to meet various pipeline sales gas specifications, including Wobbe Index (e.g., 20 MJ/$m^3$), hydrocarbon dew point, and/or water content. In most cases, natural gas plants are used to extract propane plus ($C3^+$) components. However, when the feed gas contains relatively high quantities of ethane (C2), extraction of propane is often not sufficient to produce on-spec product, mostly due to high heating value of the feed gas (mainly caused by excess quantities of ethane).

In general, the main revenue from gas plant operation is generated from sales of the condensate components, which are predominantly propane, butanes, pentanes, and heavier hydrocarbons. Hence, most of the plants are configured to maximize propane recovery. In the past, the ethane content in the feed gas was valued only for its heating content, and there were no significant incentives for ethane recovery. However, with increasing demand from petrochemical facilities to use ethane as a feedstock, ethane can now be sold at a premium price. Considering this market potential, it is thus desirable to have NGL plants for propane recovery with the provision of converting the propane recovery plant to ethane recovery in the future.

Compounding the market demand is the fact that many of today's gas fields contain excessive amount of ethane (13% and higher) that a propane recovery plant would likely fail to meet the Wobbe Index requirement (40 MJ/$m^3$) of the sales gas. Therefore, the natural gas liquids plant must be operated to reject excess ethane in order to meet the sales gas Wobbe Index. However, while many propane recovery plants can be operated on ethane rejection mode, the fractionation of propane becomes less efficient, and propane recovery drops to levels of less than 90% in many cases.

Conceptually, numerous separation processes and configurations are known in the art to fractionate the NGL fractions from natural gas. In a typical gas separation process, a high pressure feed gas stream is cooled by heat exchangers, using propane refrigeration and turbo expansion, and the extent of cooling depends on the hydrocarbon contents and desired levels of recoveries. As the feed gas is cooled under pressure, the hydrocarbon liquids are condensed and separated from the cooled gas. The cooled vapor is expanded and fractionated in distillation columns (e.g., deethanizer or demethanizer) to produce a residue gas containing mainly methane gas and an ethane plus bottom product that is transported by pipeline or other manner to a distant petrochemical facility. Unfortunately, most of the known gas plants process relatively lean gases with an ethane content of less than 10%. While such plants are generally acceptable for feed gas with low ethane content, they are not suitable if the ethane content feed gas is relatively high.

Therefore, known processes may further include an ethane rejection scheme that is needed to meet the Wobbe Index specification, however, often at the expense of desirable levels of propane recovery. For example, Rambo et al. describe in U.S. Pat. No. 5,890,378 a system in which the absorber is refluxed, in which the deethanizer condenser provides reflux streams for both the absorber and the deethanizer while cooling duties are supplied by turbo-expansion and propane refrigeration. Here, the absorber and the deethanizer both operate at essentially the same pressure. Although Rambo's configuration can recover 98% of the C3+ hydrocarbons during propane recovery operation, high ethane recovery (e.g. over 80%) is difficult even with additional reflux streams. Additionally, such configurations are often problematic where the goal is to maintain high propane recovery (e.g. over 95%) when the NGL plant is required to operate under an ethane rejection mode. The rejected ethane will contain a significant amount of propane which typically lowers the overall propane recovery to below 90%. All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

To circumvent at least some of the problems associated with low ethane recoveries, Sorensen describes in U.S. Pat. No. 5,953,935 a plant configuration in which an additional fractionation column and reflux condenser are added to increase ethane recovery using cooling with turbo expansion and Joule Thompson expansion valves for portions of the feed gas. Although Sorensen's configuration may achieve high ethane recoveries, it typically fails to achieve high propane recovery when operated on ethane rejection. Moreover, the $C2^+$ NGL product must be re-fractionated in a deethanizer in most instances to meet LPG vapor pressure specifications, thus increasing the overall energy consumption.

In yet other known configurations, high NGL recoveries were attempted with various improved fractionation and reflux configurations. Typical examples are shown in U.S. Pat. Nos. 4,278,457 and 4,854,955, to Campbell et al., in U.S. Pat. No. 6,244,070 to Elliott et al., and in U.S. Pat. No. 5,890,377 to Foglietta. While such configurations may provide at least some advantages over other known processes, they are generally intended to operate on a single recovery mode, either ethane recovery or propane recovery. Moreover, most of such known configurations require extensive modifications of turbo expanders and pipe routing when the plants are retrofitted from propane recovery to ethane recovery or vice versa. In most cases, the capital and operating cost for the retrofit processes are relatively high and the revenue losses due to facility shutdown for installation are relatively high, thus making an operational change uneconomical.

To circumvent at least some of the problems associated with high ethane recovery while maintaining a high propane recovery, a twin reflux process (described in U.S. Pat. No. 7,051,553 to Mak et al.) employs configurations in which a first column receives two reflux streams: one reflux stream comprising a vapor portion of the NGL and the other reflux stream comprising a lean reflux provided by the overhead of the second distillation column. Similarly, U.S. Pat. App. No. 2010/0206003 to Mak et al. describes an improved natural gas liquid recovery method in which residue gas is integrated to the propane recovery design such that it can be used to reflux the demethanizer during high ethane recovery. Even with these improvements, high ethane recovery (over 90%) is typically not feasible with additional reflux streams.

Thus, although various configurations and methods are known to recover natural gas liquids, all or almost all of them suffer from one or more disadvantages. For example, while some known methods and configurations can be employed for ethane recovery and propane recovery, ethane rejection will typically result in a loss in propane recovery. Moreover, most of the known plants and processes are relatively complex, difficult to operate when changing ethane modes are required, and can typically not produce a pure ethane product as a feedstock to a petrochemical plant.

Therefore, there is still a need to provide methods and configurations for an NGL recovery plant that can recover 95% ethane while maintaining high propane recovery (over 95%) during ethane rejection, and producing a pure ethane product for a petrochemical plant.

SUMMARY OF THE INVENTION

The present invention is directed to methods and configurations for high ethane recovery that allow rejection of variable amounts of ethane to the sales gas without losses in propane recovery. Most preferably, contemplated plants include a demethanizer and a deethanizer that are closely coupled with a feed gas/residue gas reflux system.

In one aspect of the inventive subject matter, the inventor contemplates a method of flexible ethane recovery that includes a step of feeding a first portion of a feed gas to a demethanizer as a first reflux and a second portion of the feed gas after cooling and expansion to the demethanizer as a demethanizer feed. In another step, a demethanizer overhead product is used in a residue gas recycle exchanger (a) to cool a portion of compressed residue gas and the first portion of the feed gas to thereby produce the first reflux and a second reflux for the demethanizer during ethane recovery, wherein first and second reflux are fed to the demethanizer at different first and second reflux locations, or (b) to cool the first portion of the feed gas in two separate heat transfer areas to thereby produce the first and second reflux to the demethanizer during ethane rejection, while feeding the first and second reflux to the demethanizer at the different first and second reflux locations. In yet another step, the demethanizer bottom product is fed to a deethanizer or deethanizer section of the demethanizer. Most typically, a plurality of switch valves are included to control switchover from ethane rejection to ethane recovery.

It is still further generally contemplated to partially condense a second portion of the feed gas, to separate the partially condensed feed gas into a liquid fraction and a vapor fraction, and to feed the liquid and vapor fraction to the demethanizer at separate locations. While not limiting to the inventive subject matter, the so obtained vapor fraction may be expanded in a turbo expander and the pressure of the liquid fraction may be reduced (e.g., via JT valve) before feeding the liquid and vapor fractions to the demethanizer.

With respect to the method of cooling of the second portion of the feed gas it is especially contemplated that the second portion of the feed gas is first cooled with propane refrigeration to −25° to −35° F., and then with the demethanizer bottom to −38° to −45° F., consequently both the refrigeration consumption by feed gas cooler and the heat duty by the demethanizer reboiler are reduced, while more methane is removed in the demethanizer before it is routed to the downstream column.

With respect to ethane, it is contemplated that an ethane stream may be withdrawn as a deethanizer overhead or deethanizer section overhead product, and/or that a portion of the deethanizer overhead product or deethanizer section overhead product may be compressed and combined with the demethanizer overhead product during ethane rejection.

In another aspect of the inventive subject matter, a residue gas recycle exchanger for flexible ethane recovery in an NGL recovery plant may therefore comprise piping and conduits for coupling the residue gas recycle exchanger to a demethanizer such that a demethanizer overhead product provides refrigeration to a portion of compressed residue gas and a portion of a feed gas to thereby produce a first and a second reflux stream to different first and second reflux locations on the demethanizer during ethane recovery. Most typically, the piping and conduits are further configured for coupling the residue gas recycle exchanger to the demethanizer such that the demethanizer overhead product provides refrigeration to the portion of the feed gas to thereby produce a first and a second feed gas reflux stream to the different first and second reflux locations on the demethanizer during ethane rejection. In further preferred aspects, the recycle exchanger may comprise or is fluidly coupled to a plurality of switch valves that are configured to control switchover from ethane rejection to ethane recovery.

Therefore, and viewed from a different perspective, a gas processing plant for flexible ethane recovery will include or be coupled to a feed gas source that provides a feed gas. A demethanizer in contemplated plants receives a demethanizer feed, and a first and a second reflux stream at different first and second reflux locations, and produces a demethanizer overhead product and a demethanizer bottom product. A deethanizer or deethanizer section is fluidly coupled to the demethanizer such that the demethanizer bottom product is fed to the deethanizer or deethanizer section, wherein the deethanizer or deethanizer section is configured to produce a C3+ bottom product and a C2 enriched overhead product. As noted above, a residue gas recycle exchanger is then fluidly coupled to the demethanizer such that the demethanizer overhead product cools (a) a portion of compressed residue gas and a first portion of the feed gas to thereby produce the first reflux and a second reflux for the demethanizer during ethane recovery, and such that the first and second reflux are fed to the demethanizer at the different first and second reflux locations; or (b) the first portion of the feed gas in two separate heat transfer areas of the residue gas recycle exchanger to thereby produce the first and second reflux to the demethanizer during ethane rejection, and such that the first and second reflux are fed to the demethanizer at the different first and second reflux locations.

In especially preferred plants, a plurality of switch valves allow for switchover from ethane rejection to ethane recovery, and/or a feed gas separator is employed to receive a partially condensed second portion of the feed gas and to separate the partially condensed second portion of the feed gas into a liquid fraction and a vapor fraction. Most typically, the feed gas separator is fluidly coupled to the demethanizer to allow feeding the liquid and vapor fraction to the demethanizer at separate locations.

Additionally, it is generally preferred that the gas processing plant further includes a turbo expander between the feed gas separator and the demethanizer to expand the vapor fraction, and a JT valve between the feed gas separator and the demethanizer to reduce pressure of the liquid fraction.

Most commonly, contemplated plants will include a conduit to allow withdrawal of the C2 enriched overhead product as a value product from the plant, and will further include a compressor that compresses the C2 enriched overhead product for combination with the demethanizer overhead product during ethane rejection. Various objects, features, aspects and advantages of the present invention will become more apparent from the following detailed description of preferred embodiments of the invention.

DETAILED DESCRIPTION

Figure 1:
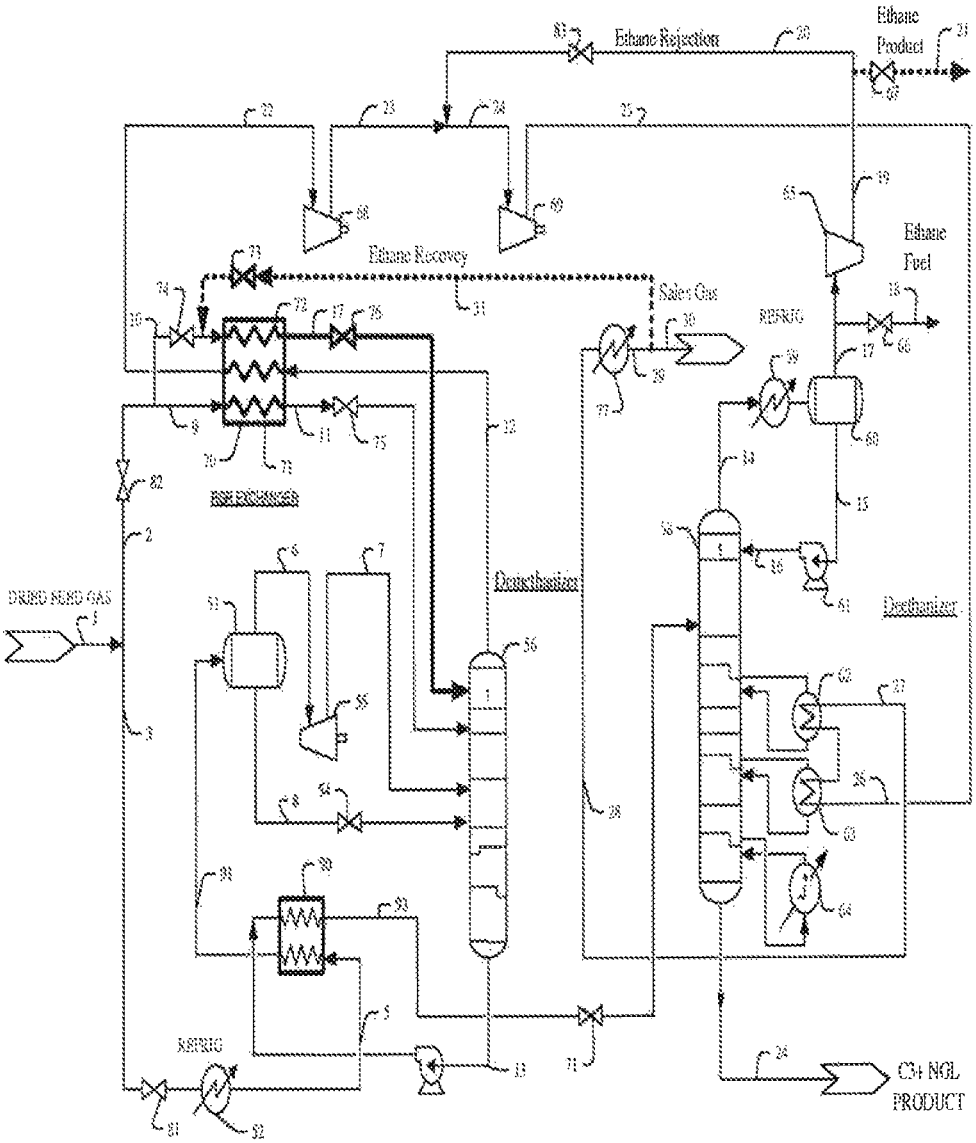
FIG. 1 is a schematic diagram of one exemplary NGL recovery method for ethane recovery and ethane rejection using a demethanizer and a deethanizer according to the inventive subject matter.

The inventor has now discovered that use of a residue gas recycle exchanger that employs at least a portion of a compressed residue gas recycle and a portion of the feed gas at the plant inlet can enable high ethane recovery of over 95% while maintaining high propane recovery of at least 95%. Most typically, the residue gas recycle exchanger is also employed in ethane rejection, and in especially preferred aspects, switching valves allow the recycle gas exchanger core to be used by the feed gas, thus avoiding residue gas recycle and minimizing compression horsepower during ethane rejection.

Therefore, and viewed from another perspective, the residue gas recycle exchanger is advantageously configured to be operated in ethane rejection and ethane recovery mode using demethanizer overhead cold in both modes of operation to produce two distinct reflux streams (with the composition of the reflux streams being different between ethane recovery and ethane rejection mode). It should be noted that the residue gas recycle exchanger allows for deep cooling of a portion of the feed gas to form a reflux stream at very low temperature for ethane rejection.

With respect to the method of cooling of the second portion of the feed gas it is especially contemplated that the second portion of the feed gas is first cooled with propane refrigeration to about −25° to about −35° F., and then with the demethanizer bottom to about −38° to about −45° F., consequently both the refrigeration consumption by feed gas cooler and the heat duty by the demethanizer reboiler are reduced, while more methane is removed in the demethanizer before it is routed to the downstream column.

Especially preferred NGL recovery plants include a demethanizer and a deethanizer for all operations, and the change from ethane recovery to ethane rejection or vice versa can be accomplished without interruption of plant operation. Moreover, the same equipment and piping can be used for both operations, and no retrofit is required to meet the minimum 95% propane recovery. It should also be recognized that contemplated plants and methods are suitable to condition feed gas to meet the sales gas Wobbe Index specification, even when the ethane content in the feed gas is high. Alternatively, NGL recovery plants can be configured using a single column that integrates the services of the demethanizer and deethanizer, which significantly reduces the plot space requirement in offshore applications. However, all of the operational benefits remain the same in such combined configuration.

During ethane recovery, contemplated methods and configurations allow production of a lean gas suitable for sales or pipeline transmission, while also enabling production of a high purity ethane stream (e.g., for petrochemical production) and a separate propane plus NGL product. On the other hand, during ethane rejection, an ethane rich sales gas is produced that can be adjusted to a desired Wobbe index along with a propane plus NGL product, and an ethane stream can be withdrawn as separate product for use elsewhere (e.g., as fuel).

It is further especially preferred that the feed gas is dried feed gas that is used in at least two distinct functions. During ethane rejection, a portion (about 20% to 35%) is chilled and condensed in a RGR (Residue Gas Recycle) exchanger to thereby form two separate reflux stream that are fed to two distinct locations to the demethanizer, while the remaining portion is cooled and partially condensed by the demethanizer bottom product stream plus external refrigeration, separated in an expander suction drum prior to feeding both fractions into the demethanizer. The vapor portion from the drum is typically expanded in a turbo expander to the demethanizer, while the liquid portion is routed to a stripping section of the demethanizer. During ethane recovery, a portion of the feed gas is chilled and condensed in the Residue Gas Recycle exchanger to thereby form a single reflux stream that is fed to a position below a top reflux stream. The top reflux stream is formed from a portion of the compressed residue gas after condensation in the RGR exchanger. Thus, the entirety of the feed gas is fed to the demethanizer in distinct fractions and distinct temperatures.

It is particularly preferred that the RGR exchanger comprises three distinct cores: a demethanizer overhead core, a feed gas core, and compressed residue gas recycle core. In such case, switching valves are provided to allow the recycle core to be used by a portion of the feed gas during ethane rejection, which reduces the residue gas compression horsepower and the temperature of the reflux as further described below. Therefore, and viewed from a different perspective, the RGR exchanger will be configured to allow use of a single core for alternately cooling two distinct streams, depending on the desired ethane processing mode. During ethane rejection, that single core is used to cool a fraction of feed gas while during ethane recovery the same single core is used for cooling a portion of residue gas. Such dual use core will advantageously allow for reduced temperatures for the feed gas reflux as well as for generation of a lean reflux from residue gas, preferably by simply switching process flows. During ethane recovery it is generally preferred that the residue gas reflux is fed to the top tray, that the second reflux is fed to at least two trays below the top tray, that the expander discharge is fed to at least two trays below the second reflux, and that the expander suction drum liquid is fed to below the expander discharge inlet.

In still further preferred aspects, it is contemplated that the deethanizer fractionates the ethane rich NGL into an ethane overhead product and a C3+ hydrocarbon bottom product. Most typically, methods and configurations contemplated herein achieve over 95% ethane recovery, and produce a high quality ethane product with at least 96% purity (that can be fed to a petrochemical plant). The C3+ product can be fractionated in a downstream debutanizer into an LPG product and a pentanes plus liquid for blending in a refinery.

Moreover, it should be recognized that during ethane rejection, the ethane product is compressed and blended with the residue gas producing a sales gas with an ethane content that meets the sales gas Wobbe Index specification. It should also be recognized that if the ethane content in the feed gas is relatively high, the sales gas may not meet the Wobbe Index requirement during ethane rejection. The excess ethane is then removed from the system and used in a downstream (e.g., fuel gas) system. Thus, and viewed from a different perspective, NGL plants contemplated herein allow ethane recovery of at least 95% and propane plus recovery of at least 95%, with the flexibility of rejection ethane to meet sales gas specification while maintaining propane recovery of 95% or higher. Therefore, it should be appreciated that configurations and methods contemplated herein allow high ethane content feed gas to be conditioned to meet sales gas Wobbe Index specification. Typical sales gas Wobbe Index is limited to ethane content of 10 to 12%. If the ethane content in the feed gas is higher, excess ethane must be removed, which can be readily accomplished with the ethane rejection methods of the present inventive subject matter.

In one exemplary configuration, as depicted in FIG. 1, an NGL recovery plant has a first column (demethanizer) 56 that is fluidly coupled to a second column (deethanizer) 58. The feed gas can be a feed gas with variable hydrocarbon content and ethane content (e.g., 5-10 mol %, 5-15 mol %, 5-20 mol %, and even higher) and is typically supplied at a temperature of about 40° C. and a pressure of about 80 barg. Moreover it is generally preferred that the feed gas is at least partially dried (e.g., using a glycol contactor, mol sieves, etc.). As used herein, the term "about" in conjunction with a numeral refers to range of that numeral +/−10, inclusive. For example, where a temperature is "about 40° C.", a temperature range of 45-55° C., inclusive, is contemplated.

The following exemplarily describes the ethane recovery operation of contemplated processes shown in FIG. 1. Here, feed gas stream 1 entering the plant is first split into two portions, stream 2 and stream 3, by adjusting control valves 81 and 82. Stream 2, about 20% to 30% of the feed gas flow, is chilled and condensed in the RGR exchanger 70 generating a subcooled liquid stream 11, at about −90° C. which is letdown in pressure via JT valve 75 to a tray located at least 2 trays below the top tray of the demethanizer 56. About 15-25% of the compressed residue gas is also cooled and condensed in the RGR exchanger 70 generating a subcooled liquid stream 17 at about −90° C. which is letdown in pressure via valve 76 and fed to the top tray of the demethanizer 56.

During ethane recovery operation, valve 73 is open and valve 74 is closed, which opens the top core 72 of exchanger 70 for residue gas recycle. The remaining portion of the feed gas, at about 70 to 80% of the feed gas flow, is cooled using propane chiller 52 to about −25 to −35° C., thus forming a two phase stream 5. The chilled stream is further chilled in exchanger 90 using absorber bottom stream 93, to −38 to −45° F. forming stream 91 and separated in separator 51 into vapor stream 6 and liquid stream 8. Vapor stream 6 is letdown in pressure via expander 55, chilled to about −65° C. and fed to the demethanizer as stream 7 at a location at least 2 trays below the second reflux. The liquid stream 8 is fed to the demethanizer via JT valve 54, and the power produced from the expander 55 is preferably used to drive re-compressor 68.

During ethane recovery, absorber 56 operates at about 33 barg, producing an overhead vapor stream 12 at about −90° C. and a bottom ethane plus bottoms product stream 13 at about 44° C. The liquid is letdown in pressure via valve 71 to about 28 barg and fed to the upper section of deethanizer 58. The deethanizer operates with reflux condenser 59 using propane refrigeration and a bottom reboiler 64 using low pressure steam, producing a high purity ethane and LPG product with an ethane content less than 1 vol. %.

The demethanizer overhead stream 12 is heated in RGR exchanger 70 to about 20° C., forming stream 22 that is compressed by the re-compressor 68 forming stream 23 and compressor 69 to about 103 barg to meet the sales gas pressure. The residue compressor discharge stream 25/26 at about 150° C. is routed to the fractionation columns supplying heat to reboilers 63, 62 (to so form streams 27 and 28). The residue gas exiting reboiler 62 is further cooled in cooler 77 with cooling water to 35° C. forming stream 29. Recycle stream 31, which is typically about 20% of the residue gas (but may also be between 10-30% of the residue gas) is recycled back to the RGR Exchanger as reflux to the demethanizer while the remaining portion, stream 30, is sent to the sales gas pipeline.

Deethanizer 58 operates at about 28 barg, producing an ethane overhead stream 14 that is cooled in propane chiller 59 to about 7° C. The two phase stream is separated in reflux drum 60, producing liquid stream 15 and vapor stream 17. The liquid stream is pumped by pump 61 forming stream 16 that is fed to the top of the deethanizer while the vapor stream is compressed by compressor 65 to about 45 barg, forming stream 19 that is sent to the ethane consumer. During ethane recovery, valve 67 is opened and valve 83 is closed for ethane export of ethane product stream 21. Deethanizer 58 produces C3+ NGL bottom product stream 24.

With respect to the ethane rejection operation, it should be appreciated that there are no equipment or pipeline modifications required for this operation, and the only changes are the operating conditions as also exemplarily shown in FIG. 1. During ethane rejection the residue gas recycle is stopped by closing valve 73 and opening valve 74. The residue gas core 72 can now be used exclusively for chilling the feed gas. It should be particularly appreciated that with the additionally available heat transfer area (core 72 in addition to core 71, both fed by streams 9 and 10 of feed gas portion 2) in RGR exchanger 70, the temperature of the feed gas reflux is significantly lower, resulting in a higher thermal efficiency. To reduce residue compressor horsepower, the demethanizer pressure is increased to about 34 barg, and the feed gas reflux temperature is increased to about −65° C. With these changes the demethanizer can operate with less reflux and less refrigeration and requires less compression horsepower (typically, 15 to 20% lower).

It should also be noted that in ethane rejection mode the methane content in the ethane plus bottom is maintained at about 1 volume %, and ethane recovery dropped to about 70%. Operation of the deethanizer is the same as the ethane recovery operation, rejecting an ethane overhead stream 14/17. To meet the sales gas Wobbe Index requirement, the ethane content in the sales gas is controlled by sending a slip stream 66 to the fuel gas system as fuel stream 18. The remaining ethane stream is compressed by compressor 65 forming stream 19/20, and blended with residue gas stream 23 forming stream 24 and further compressed by the residue gas compressor 69 to the sales gas pipeline. During this operation, valve 67 is closed and valve 83 is opened. Tables 1 and 2 below exemplarily show heat and material balances for ethane recovery and ethane rejection, respectively.

Figure 3:
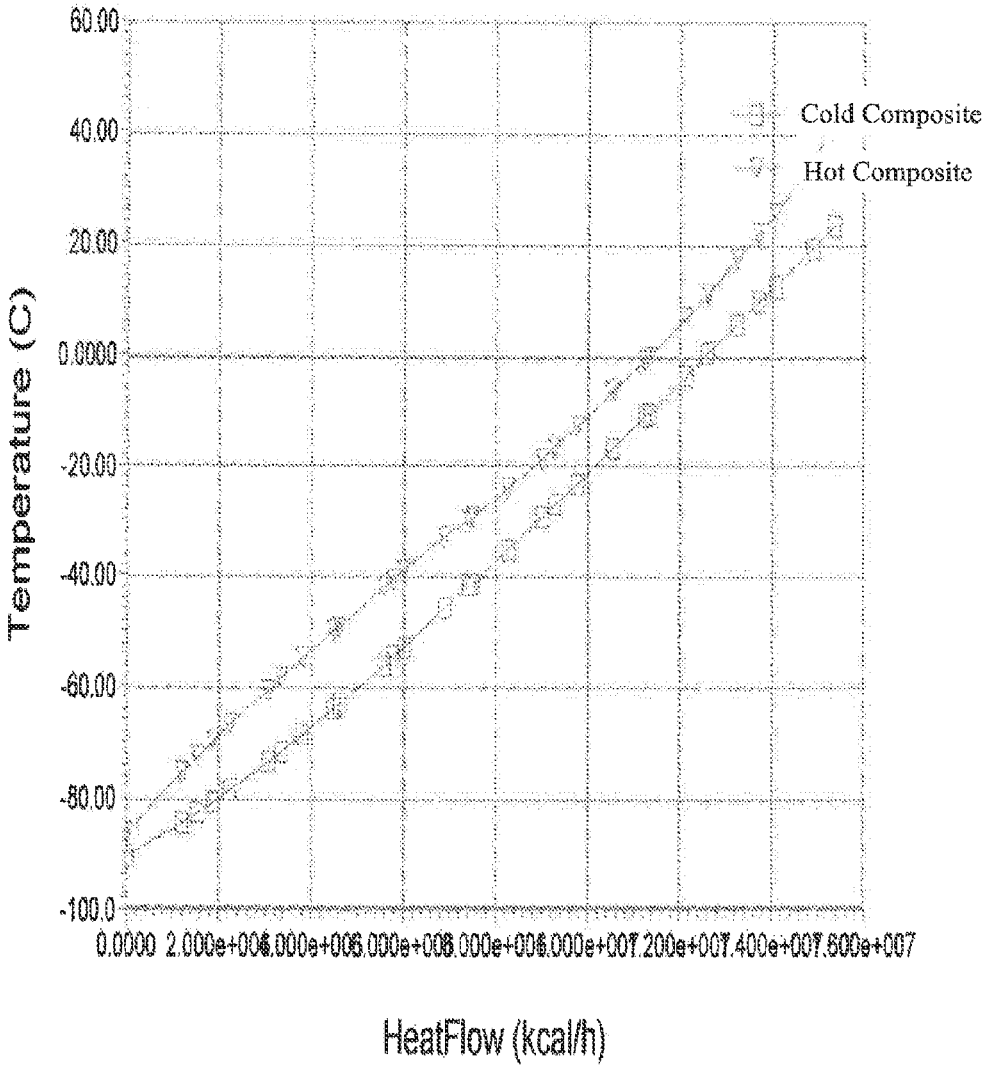
FIG. 3 is a graph depicting an exemplary heat composite curve for the ethane residue gas recycle exchanger according to the inventive subject matter.

FIG. 3 illustrates the high efficiency of the process as is evident from the heat composite curve of the ethane residue gas recycle exchanger.

TABLE 1

| | STREAM NUMBER | | | |
|---|---|---|---|---|
| | 1 | 30 | 24 | 67 |
| | DESCRIPTION | | | |
| COMPONENT | Dry Gas Mole % | Sale Gas Mole % | C3 + NGL Mole % | Ethane Export Mole % |
| Nitrogen | 0.73 | 0.97 | 0.00 | 0.00 |
| $CO_2$ | 0.00 | 0.00 | 0.00 | 0.01 |
| Methane | 73.96 | 98.04 | 0.00 | 1.50 |
| Ethane | 13.97 | 0.96 | 0.68 | 97.00 |
| Propane | 7.78 | 0.04 | 67.53 | 1.49 |
| i-Butane | 0.79 | 0.00 | 7.04 | 0.00 |
| n-Butane | 1.85 | 0.00 | 16.57 | 0.00 |
| i-Pentane | 0.35 | 0.00 | 3.09 | 0.00 |
| n-Pentane | 0.44 | 0.00 | 3.93 | 0.00 |
| Hexane+ | 0.13 | 0.00 | 1.14 | 0.00 |
| $H_2S$ | 0.00 | 0.00 | 0.00 | 0.00 |
| $H_2O$ | 0.00 | 0.00 | 0.00 | 0.00 |
| TOTAL | 100.00 | 100.00 | 99.98 | 100.00 |
| Molar Flow, kg mole/h | 301,877.9 | 159,106.3 | 72,251.5 | 52,983.3 |
| Molecular Weight | 21.9 | 16.3 | 49.8 | 30.1 |
| Temperature, ° C. | 43.5 | 35.0 | 91.6 | 41.2 |
| Pressure, $kg/cm^2g$ | 82.4 | 101.9 | 27.8 | 44.0 |

TABLE 2

| | STREAM NUMBER | | | |
|---|---|---|---|---|
| | 1 | 30 | 24 | 67 |
| | DESCRIPTION | | | |
| COMPONENT | Dry Gas Mole % | Sale Gas Mole % | C3 + NGL Mole % | Ethane Reject to Fuel Mole % |
| Nitrogen | 0.71 | 0.84 | 0.00 | 0.00 |
| $CO_2$ | 1.96 | 2.01 | 0.00 | 6.63 |
| Methane | 72.52 | 84.71 | 0.00 | 1.55 |
| Ethane | 13.70 | 12.01 | 0.67 | 90.90 |
| Propane | 7.62 | 0.41 | 67.20 | 0.91 |
| i-Butane | 0.77 | 0.01 | 7.08 | 0.00 |
| n-Butane | 1.82 | 0.02 | 16.73 | 0.00 |
| i-Pentane | 0.34 | 0.00 | 3.13 | 0.00 |
| n-Pentane | 0.43 | 0.00 | 4.00 | 0.00 |
| Hexane+ | 0.12 | 0.00 | 1.16 | 0.00 |
| $H_2S$ | 0.00 | 0.00 | 0.00 | 0.00 |
| $H_2O$ | 0.00 | 0.00 | 0.00 | 0.00 |
| TOTAL | 100.00 | 100.00 | 99.98 | 100.00 |
| Molar Flow, kg mole/h | 313,794.7 | 209,703.1 | 71,138.0 | 15,072.3 |
| Molecular Weight | 22.4 | 18.5 | 49.9 | 30.9 |
| Temperature, ° C. | 32.0 | 35.0 | 91.8 | 4.1 |
| Pressure, $kg/cm^2g$ | 82.4 | 101.9 | 27.8 | 27.4 |

Figure 2:
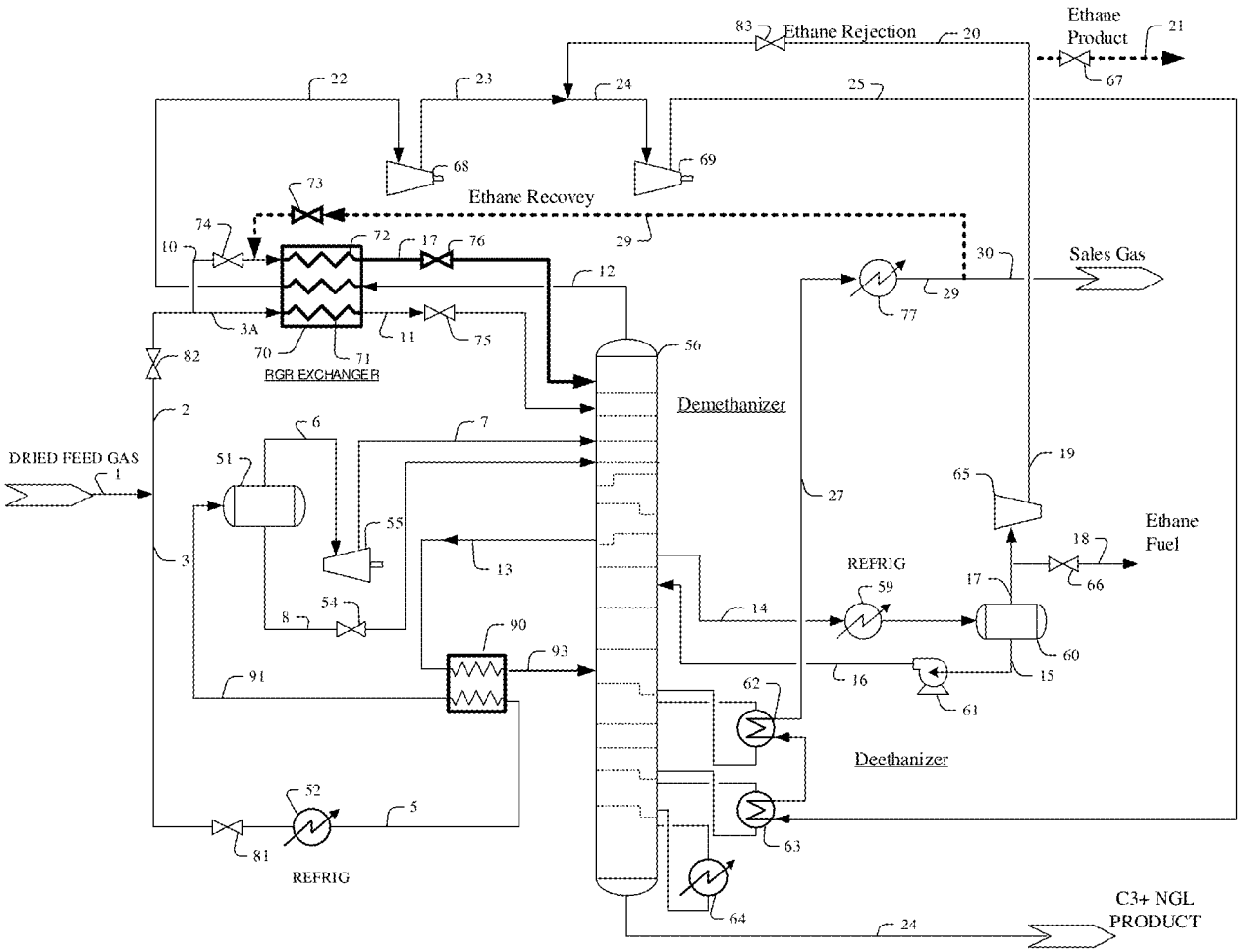
FIG. 2 is a schematic diagram of another exemplary NGL recovery method for ethane recovery and ethane rejection using a single column according to the inventive subject matter.

In another exemplary configuration as depicted in FIG. 2, an NGL recovery plant has a single column 56 that combines the functions of demethanizer and deethanizer. All the process variables are the same as the configuration of FIG. 1, and with respect to the same numerals between FIGS. 1 and 2, the same considerations as provided above apply, unless stated otherwise. The top section serves the demethanizer function, with the demethanizer bottom stream 13 routed to the upper section of the deethanizer. The deethanizer section produces an overhead vapor stream 14 that is condensed by chiller 59 and separated in reflux drum 60 in the same fashion as noted for FIG. 1 above. Among other advantages, a single column design minimizes the plot space requirement which may reduce the cost for an offshore installation.

With respect to suitable feed gas streams, it is contemplated that different feed gas streams are acceptable, and especially feed gas streams may contain high level of ethane content. With respect to the gas compositions, it is generally preferred that the feed gas stream predominantly includes C1-C6 hydrocarbons and nitrogen and other inert compounds. Thus, and viewed from a different perspective, preferred feed gas streams are associated and non-associated gas from oil and gas production units.

Most preferably, contemplated natural gas liquids plants will use a demethanizer and a deethanizer in a two column or single column design, wherein the demethanizer is refluxed with two lean liquids streams from the residue gas and the feed gas during ethane recovery, and refluxed with one lean liquid stream from the feed gas during ethane rejection. The deethanizer produces a pure ethane product that can be fed directly to the petrochemical plants or blended with the residue gas as pipeline gas during ethane rejection, with rejected excess ethane sent to fuel. Such plants allow ethane recovery of at least 95% and propane recovery of at least 95% during ethane recovery with the flexibility of rejecting ethane to the fuel system to meet the sales gas Wobbe Index requirement of 40 MJ/m3. High propane recovery of 95% is maintained during the ethane rejection operation.

Viewed from an efficiency perspective, contemplated methods and configurations use the demethanizer side reboiler for cooling which reduces refrigeration consumption and uses waste heat from the residue gas to provide heating to the reboilers in the deethanizer and demethanizer. Most advantageously, no process changes are required to switch from ethane recovery to ethane rejection. Hence, contemplated plants are easy to operate and maintain without the complexity of other heretofore known systems. Moreover, contemplated plants and processes require fewer pieces of equipment, thereby minimizing plant footprint and overall cost. Thus, the demethanizer side reboiler and reboiler allow production of ethane rich hydrocarbon bottoms that is fed to the mid-section of the downstream deethanizer. It should be recognized that the side reboiler advantageously reduces refrigeration duty, and that the reboiler duty is supplied by waste heat from the residue gas compressor discharge, which also reduces heating and cooling requirements.

With respect to ethane recovery, it is contemplated that such configurations provide at least 90%, more typically at least 94%, and most typically at least 96%, while it is contemplated that propane recovery will be at least 95%, more typically at least 98%, and most typically at least 99%. Further related configurations, contemplations, and methods are described in our U.S. application US2010/0206003, US2010/0011809, US2013/0014390, and International patent applications with the publication numbers WO 2005/045338, WO 2007/149463, WO 2008/002592, and WO 2007/014069, all of which are incorporated by reference herein.

Thus, specific embodiments and applications for improved natural gas liquids recovery have been disclosed. It should be apparent, however, to those skilled in the art that many more modifications besides those already described are possible without departing from the inventive concepts herein. The inventive subject matter, therefore, is not to be restricted except in the spirit of the present disclosure.

Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A method of flexible ethane recovery in a gas processing plant for processing a feed gas including a first portion of the feed gas and a second portion of the feed gas, wherein the gas processing plant is configurable in either an ethane recovery configuration or an ethane rejection configuration, the method comprising:

feeding a first reflux stream, a second reflux stream, and a demethanizer feed to a demethanizer; wherein the second portion of the feed gas forms the demethanizer feed after cooling and expansion, and wherein the first and second reflux streams are fed to the demethanizer at different first and second reflux locations;

routing a demethanizer overhead product stream to a residue gas recycle exchanger having a first and second heat transfer pathway through the recycle exchanger, wherein;

when the gas processing plant is in the ethane recovery configuration, the demethanizer overhead product stream is used to cool the first portion of the feed gas in the first heat transfer pathway to thereby produce the first reflux stream and to cool a portion of compressed residue gas in the second heat transfer pathway to thereby produce the second reflux stream; and when the gas processing plant is in the ethane rejection configuration, the demethanizer overhead product is used to cool the first portion of the feed gas in each of the first and second heat transfer pathways to thereby produce the first and second reflux streams; and using a demethanizer bottom to cool the second portion of the feed gas and feeding the demethanizer bottom after the cooling step to a deethanizer or deethanizer section of the demethanizer.

2. The method of claim 1 further comprising using a plurality of switch valves to control switchover from the ethane rejection configuration to the ethane recovery configuration.

3. The method of claim 1 wherein the second portion of the feed gas is cooled to −38° to −45° F. to partially condense the second portion of the feed gas, and further comprising separating the partially condensed second portion of the feed gas into a liquid fraction and a vapor fraction, and feeding the liquid and vapor fraction to the demethanizer at separate locations.

4. The method of claim 3 further comprising a step of expanding the vapor fraction in a turbo expander and reducing pressure of the liquid fraction before feeding the liquid and vapor fraction to the demethanizer.

5. The method of claim 1 further comprising a step of withdrawing an ethane stream as a deethanizer overhead product or deethanizer section overhead product.

6. The method of claim 1 further comprising a step of compressing a deethanizer overhead product or deethanizer section overhead product and combining the compressed overhead product with the demethanizer overhead product during ethane rejection.

7. A gas processing plant for flexible ethane recovery when processing a feed gas including a first portion of the feed gas and a second portion of the feed gas, wherein the as processing plant is configurable in either an ethane recovery configuration or an ethane rejection configuration, wherein the gas processing plant comprises:

a demethanizer configured to receive a first reflux stream and a second reflux stream, wherein the first reflux stream and the second reflux stream are received by the demethanizer at different first and second reflux locations; and a residue gas recycle exchanger having a first and second heat transfer pathway through the recycle exchanger, the residue gas recycle exchanger being fluidly coupled to the demethanizer such that:

when the gas processing plant is in the ethane recovery configuration, a demethanizer overhead product provides refrigeration to cool the first portion of the feed gas stream in the first heat transfer pathway to thereby produce the first reflux stream to the demethanizer and to cool a compressed residue gas stream in the second heat transfer pathway to thereby produce the second reflux stream to the demethanizer; and when the gas processing plant is in the ethane rejection configuration, the demethanizer overhead product provides refrigeration to cool the portion of the feed gas in each of the first and second heat transfer pathways to thereby produce the first and second reflux streams.

8. The gas processing plant of claim 7, wherein the recycle exchanger is fluidly coupled to a plurality of switch valves that are configured to control switchover from the ethane rejection configuration to the ethane recovery configuration.

9. A gas processing plant for flexible ethane recovery, wherein the gas processing plant is configurable in either an ethane recovery configuration or an ethane rejection configuration, wherein the gas processing plant comprises:

a feed gas source configured to provide a feed gas, including a first portion of the feed gas and a second portion of the feed gas;

a demethanizer configured to receive a demethanizer feed stream, a first reflux stream, and a second reflux stream, wherein the first reflux stream and the second reflux stream are received by the demethanizer at different first and second reflux locations, and wherein the demethanizer is also configured to produce a demethanizer overhead product and a demethanizer bottom product;

a deethanizer or deethanizer section fluidly coupled to the demethanizer such that the demethanizer bottom product is used to cool the second portion of the feed gas and is then fed to the deethanizer or deethanizer section, and wherein the deethanizer or deethanizer section is configured to produce a C3+ bottom product and a C2 enriched overhead product;

a residue gas recycle exchanger having a first and second heat transfer pathway through the recycle exchanger, the residue gas recycle exchanger being fluidly coupled to the demethanizer such that:

(a) when the gas processing plant is in the ethane recovery configuration, the demethanizer overhead product cools the first portion of the feed gas in the first heat transfer pathway to thereby produce the first reflux stream and cools a portion of compressed residue gas in the second heat transfer pathway to thereby produce the second reflux stream; and;

(b) when the gas processing plant in the ethane rejection configuration, the demethanizer overhead product cools the first portion of the feed gas in each of the first and second heat transfer pathways to thereby produce the first and second reflux streams.

10. The gas processing plant of claim 9 further comprising using a plurality of switch valves that are configured to allow for switchover from the ethane rejection configuration, to the ethane recovery configuration.

11. The gas processing plant of claim 9 further comprising a feed gas separator that is configured to receive a partially condensed second portion of the feed gas, to separate the partially condensed second portion of the feed gas into a liquid fraction and a vapor fraction, wherein the feed gas separator is fluidly coupled to the demethanizer to allow feeding the liquid and vapor fraction to the demethanizer at separate locations.

12. The gas processing plant of claim 11 further comprising a turbo expander fluidly coupled between the feed gas separator and the demethanizer to expand the vapor fraction, and a JT valve fluidly coupled between the feed gas separator and the demethanizer to reduce pressure of the liquid fraction.

13. The gas processing plant of claim 9 further comprising a conduit that is configured to allow withdrawal of the C2 enriched overhead product from the plant.

14. The gas processing plant of claim 9 further comprising a compressor configured to compress the C2 enriched overhead product for combination with the demethanizer overhead product when the gas processing plant is configured in the ethane rejection configuration.

* * * * *